US010046355B2

(12) United States Patent
Belanger et al.

(10) Patent No.: US 10,046,355 B2
(45) Date of Patent: Aug. 14, 2018

(54) CARTRIDGE DISPENSER FOR LIQUID OR SEMI-LIQUID MATERIALS

(71) Applicant: ADHESIVE TECHNOLOGIES, INC., Hampton, NH (US)

(72) Inventors: Richard A. Belanger, Kensington, NH (US); Peter S. Melendy, Brentwood, NH (US)

(73) Assignee: Adhesive Technologies, Inc., Hampton, NH (US)

( * ) Notice: Subject to any disclaimer, the term of this patent is extended or adjusted under 35 U.S.C. 154(b) by 69 days.

(21) Appl. No.: 14/506,916

(22) Filed: Oct. 6, 2014

(65) Prior Publication Data

US 2015/0021359 A1 Jan. 22, 2015

Related U.S. Application Data

(63) Continuation of application No. 10/588,278, filed as application No. PCT/US2005/003465 on Feb. 7, 2005, now abandoned.

(60) Provisional application No. 60/541,773, filed on Feb. 5, 2004.

(51) Int. Cl.
*B05C 17/01* (2006.01)
*B05C 17/005* (2006.01)

(52) U.S. Cl.
CPC .... *B05C 17/0116* (2013.01); *B05C 17/00523* (2013.01); *B05C 17/01* (2013.01)

(58) Field of Classification Search
CPC ..... B05C 17/0116; B05C 17/00523; B05C 17/01
USPC ..... 222/146.5, 391, 326, 327
See application file for complete search history.

(56) References Cited

U.S. PATENT DOCUMENTS

| | | | |
|---|---|---|---|
| 3,228,566 | A | 1/1966 | Knox |
| 4,033,484 | A | 7/1977 | Ornsteen |
| 4,065,034 | A | 12/1977 | Callan |
| 4,090,639 | A | 5/1978 | Campbell et al. |
| 4,303,108 | A | 12/1981 | Akers et al. |
| 4,390,115 | A | 6/1983 | Bigham |
| 4,461,407 | A | 7/1984 | Finnegan |
| 4,523,705 | A | 6/1985 | Belanger et al. |
| 4,655,372 | A | 4/1987 | Ross et al. |
| 4,826,049 | A | 5/1989 | Speer |
| 4,905,550 | A | 3/1990 | Albrecht |

(Continued)

FOREIGN PATENT DOCUMENTS

| | | |
|---|---|---|
| GB | 2 358 676 | 8/2001 |
| JP | 59-97768 | 7/1984 |

(Continued)

*Primary Examiner* — Nicholas J Weiss
(74) *Attorney, Agent, or Firm* — Clark & Brody

(57) ABSTRACT

A dispenser for a fluid material includes a handle portion and a cartridge having the material to be dispensed. The cartridge is easily mounted to the handle portion or removed, whereby the handle portion may be used with a variety of cartridges, each of which may contain a selected material. The handle portion includes a plunger that is moved linearly by actuation of a trigger mechanism, which is engaged by a user's finger. The trigger mechanism is configured to release pressure applied to the plunger quickly upon release of pressure on the trigger and to allow the plunger to move away from the cartridge to ensure release of pressure in the material to be dispensed to prevent dripping.

9 Claims, 6 Drawing Sheets

(56) References Cited

U.S. PATENT DOCUMENTS

| | | | | |
|---|---|---|---|---|
| 4,951,846 | A | 8/1990 | Oster et al. | |
| 5,431,654 | A | 7/1995 | Nic | |
| 5,638,997 | A | 6/1997 | Hawkins et al. | |
| 5,849,358 | A | 12/1998 | Le Riche et al. | |
| 5,887,765 | A | 3/1999 | Broesamle | |
| 5,893,488 | A | 4/1999 | Hoag et al. | |
| 6,439,438 | B1 | 8/2002 | Schouten et al. | |
| 6,883,684 | B2 | 4/2005 | Jeter et al. | |
| 6,938,804 | B2 * | 9/2005 | Chen | B05C 17/01 222/327 |
| 7,073,691 | B2 | 7/2006 | Rumrill et al. | |
| 2005/0230423 | A1 | 10/2005 | Riney et al. | |
| 2007/0017935 | A1 | 1/2007 | Rumrill et al. | |

FOREIGN PATENT DOCUMENTS

| | | |
|---|---|---|
| JP | 61-68161 | 4/1986 |
| JP | 63-36868 | 2/1988 |
| JP | 7-39802 | 2/1995 |
| JP | 3024808 | 3/1996 |
| JP | 10-85645 | 4/1998 |
| JP | 2002-254913 | 3/2004 |
| WO | 99/18027 | 4/1999 |
| WO | 99/37407 | 7/1999 |

* cited by examiner

CARTRIDGE DISPENSER FOR LIQUID OR SEMI-LIQUID MATERIALS

TECHNICAL FIELD

This invention relates to the art of dispensers for liquid or semi-liquid materials. In particular, the invention relates to a dispenser for such materials having a handle portion and a replaceable cartridge and, optionally, a heater for heating the material in the cartridge.

BACKGROUND

This invention relates to dispensers of materials that are liquid or semi-liquid, and capable of flowing, including but not limited to adhesives, sealants, caulks, greases, and paints. These materials will be referred to herein generally as fluid materials. Dispensers for these materials are known, and one known dispenser is the hot melt glue gun, which typically uses glue that can be formed into sticks rigid enough at room temperature to be urged into a melt chamber by a feed mechanism that grips the stick. Theses glue guns are limited, however, because they cannot utilize adhesives that are not sufficiently rigid at room temperatures. For example, these glue guns are not useful with adhesive compositions that are liquid or semi-liquid at room temperatures.

Dispensers are known for fluid materials, and these may take the form, for example, of the known caulking gun. In this structure, the caulk is placed in a tube that is received in a dispenser of some sort. There is a myriad of design approaches for these dispensers, and a typical dispenser has a plunger operated by a trigger mechanism whereby the plunger is urged into one end of the tube as the trigger is advanced to force the caulk from the opposite end of the tube by increasing the pressure in the tube. A problem with this type of dispenser is that the material in the tube may remain under pressure even after the motion of the plunger is terminated, which results in dripping from the nozzle. One factor in this problem is that the plunger is not necessarily fully released by relaxation of pressure on the trigger, which allows the material in the cartridge to remain under some degree of pressure.

SUMMARY OF THE INVENTION

In accordance with the invention, a dispenser for fluid materials comprises one or more cartridges having the fluid material therein and a handle for removably receiving the cartridges. The cartridge is in the form of a tube, generally, and in addition to the fluid material to be dispensed includes a movable piston at one end and a valve adjacent a selected dispensing tip at the other. The handle portion includes a plunger mounted for linear movement to engage the movable piston in the cartridge, the plunger being operated by the user.

The handle portion is advantageously configured to engage one end of the cartridge in such a manner that it can be attached or removed in a single motion as well as rotated about its longitudinal axis. The arrangement also allows the cartridge to extend forwardly of the handle by a substantial distance to facilitate heating the cartridge and to provide a compact design. The handle has a first portion with an annular slot that engages an annular flange on one end of the cartridge and a trigger portion extending forwardly from the first portion just below the cartridge. The annular extent of the slot is preferably about 180 degrees but may be slightly more or less to allow the flange to be slid into or out of the slot easily in a direction transverse to the longitudinal axis of the cartridge. By this construction, the engagement between the flange and the slot secures the cartridge to the handle. While this configuration is preferred, it is contemplated also that different structures can be provided to mount the cartridge to the handle. For example, the slot could be discontinuous or configured to engage the flange in a twisting motion.

The handle portion further includes a plunger and trigger-controlled mechanism for advancing the plunger into the cartridge to expel the fluid material. The advancing mechanism preferably comprises a movable housing with a pivoting gripper mounted to the housing to engage a toothed or resiliently deformable surface on the plunger in response to movement of a trigger by the user. The gripper rotates to engage the plunger upon movement of the trigger and to advance it into the cartridge by movement of the housing upon further movement of the trigger. Release of pressure on the trigger allows the gripper to pivot away from the plunger instantly, which releases contact between the housing and the plunger, releases the pressure applied by the plunger to the cartridge, and allows the fluid material in the cartridge to push back on the plunger if necessary to ensure release of pressure in the cartridge. This effectively prevents dripping of the fluid materials when pressure on the trigger is released.

In accordance with another feature of the glue gun of the invention, a heater stand is provided that receives the cartridge for heating the adhesive. The heater stand provides a cavity for receiving the cartridge attached to the handle portion and for holding the cartridge and handle portion when not in use.

DETAILED DESCRIPTION OF THE PREFERRED EMBODIMENTS

Figure 1:
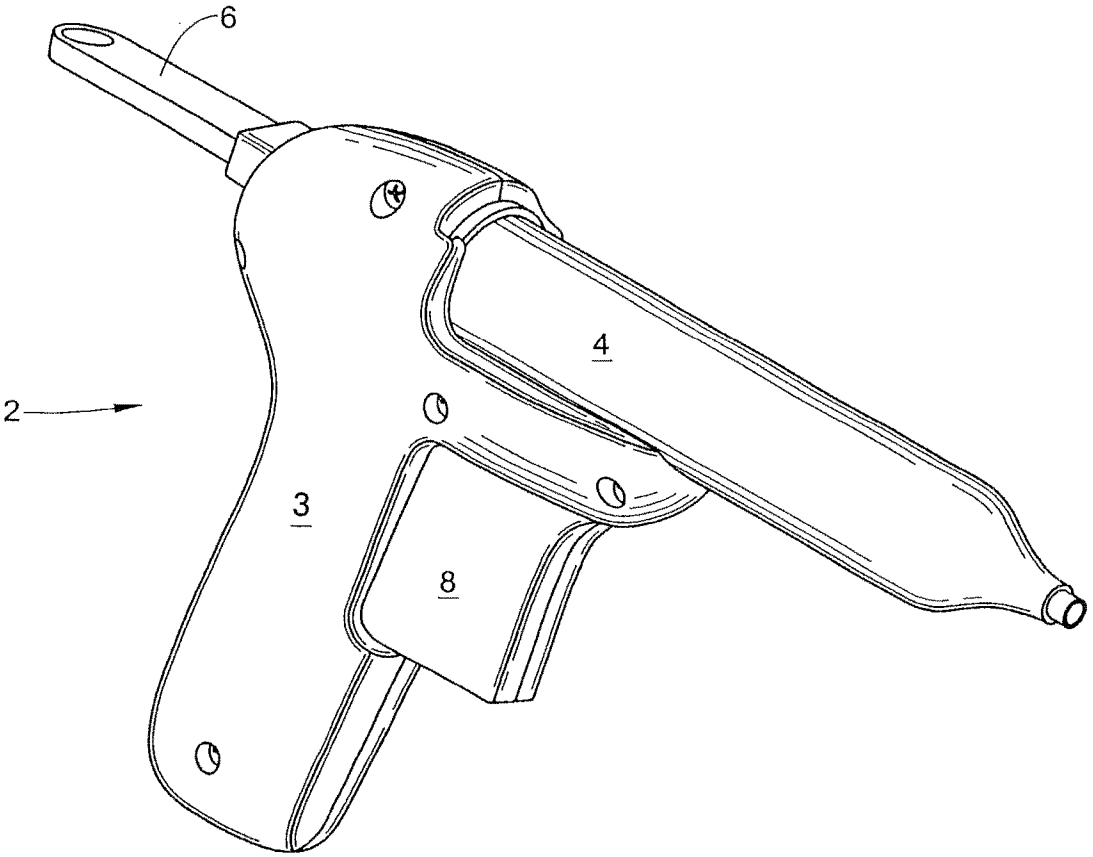
FIG. 1 is a perspective of a glue gun in accordance with the invention, with a glue cartridge in place.
Figure 2:
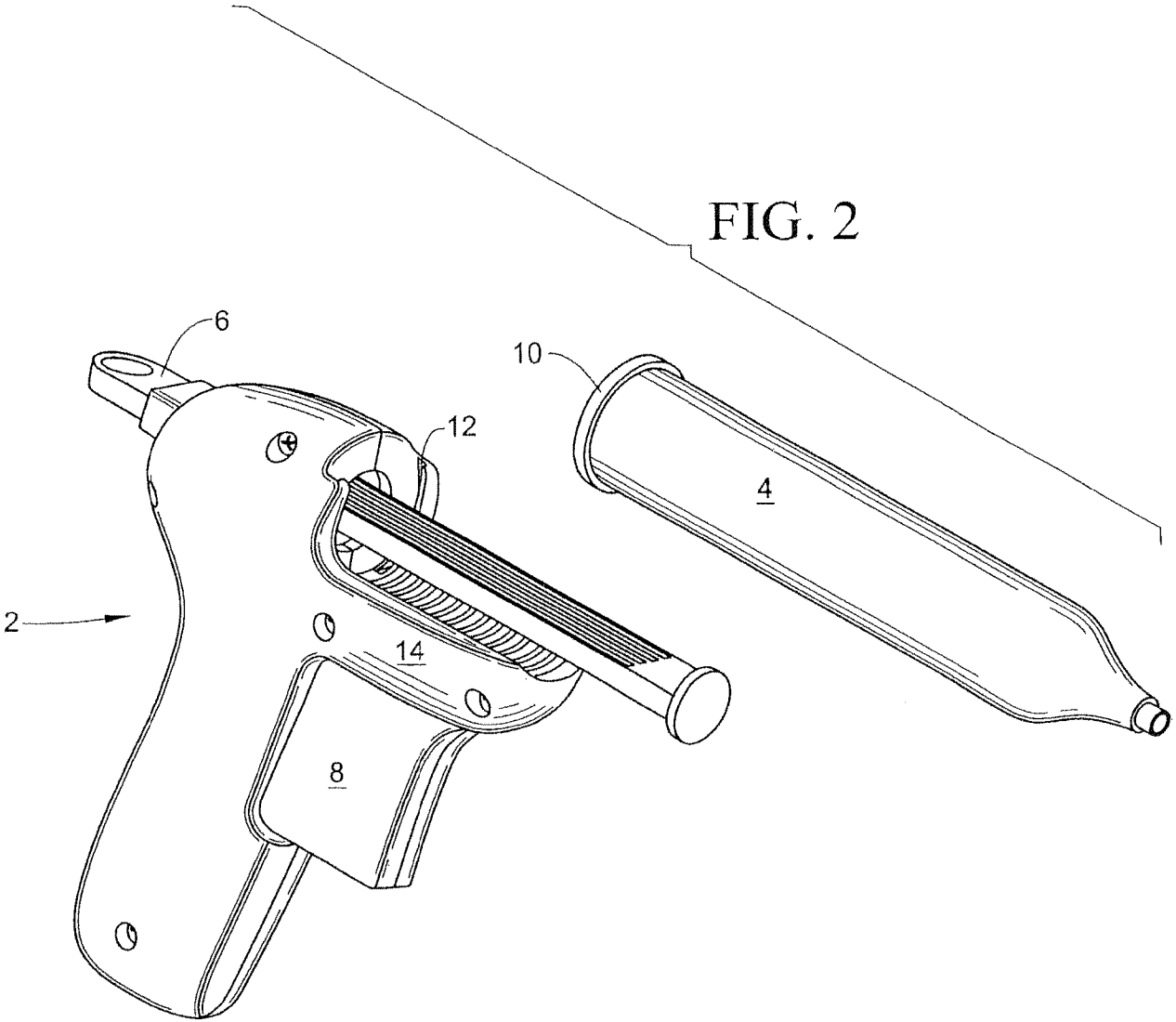
FIG. 2 is an exploded perspective of the glue gun of FIG. 1 showing the cartridge removed from the handle.

With reference to FIG. 1, the dispenser of the invention comprises a handle portion 2 and a cartridge portion 4. The handle portion is formed by a shell 3, which may be molded plastic, and includes a plunger 6 slidingly mounted in the shell for movement, and which the user controls by trigger 8. With reference to FIG. 2, it will be appreciated that in the preferred embodiment, the cartridge includes a flange, or lip, 10 at one end and that this flange is configured to engage a slot 12 in a first portion of the handle when the cartridge is in an operative position on the handle as shown in FIG. 1. Handle 2 also includes a trigger portion 14 that extends forward of the first portion to support the trigger 8. It will be appreciated that this construction provides easy installation or removal of the cartridge to facilitate use of a variety of adhesive compositions during a single project. In addition, the preferred construction described allows the cartridge to rotate about its longitudinal axis, which allows the user to orient the dispensing nozzle to a desired orientation when a non-symmetric nozzle is used. The slot and flange preferably fully support the cartridge so that it does not contact the handle portion at other locations to prevent transfer of heat for a heated cartridge to the handle portion.

Figure 3:
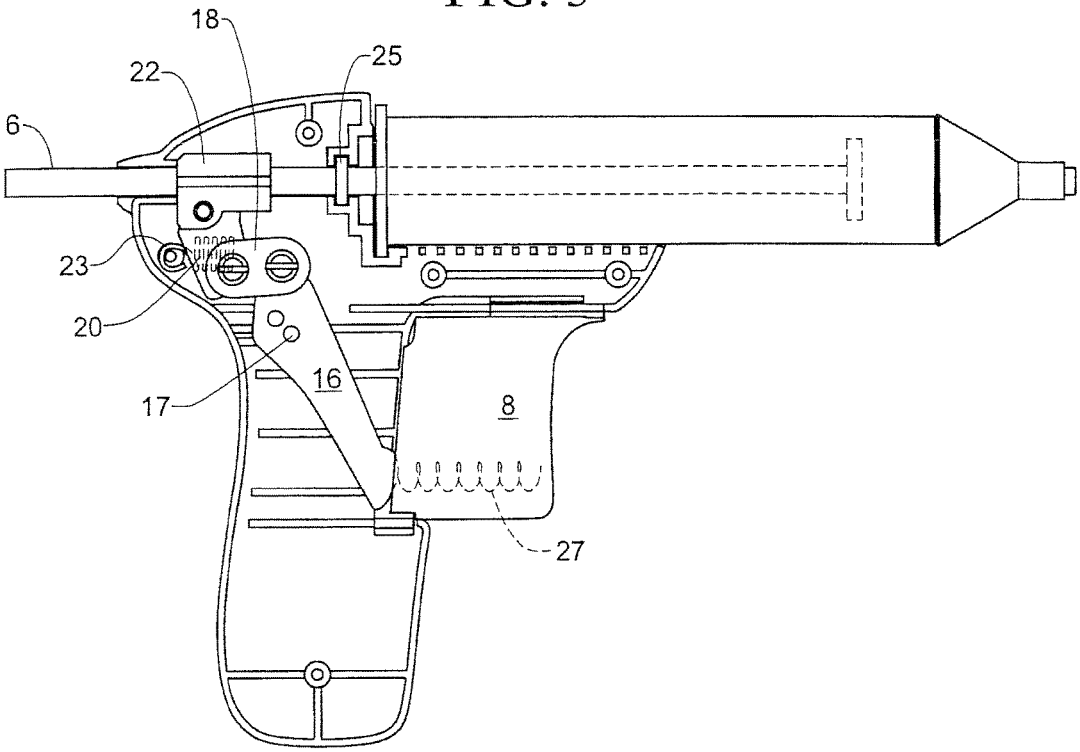
FIG. 3 is partial vertical cross section of the handle portion of the glue gun of FIG. 1.

FIG. 3 illustrates the preferred mechanism for advancing the plunger 6. While any of several similar mechanisms may be used, the mechanism illustrated is similar to that shown in U.S. Pat. No. 4,523,705. The illustrated mechanism includes the trigger 8, which engages a lever 16 that is pivotally mounted to the housing at 17. The upper part of the lever is connected by a link 18 to a pivoting gripper 20. The gripper is pivotally mounted to a housing 22 through which the plunger 6 passes. The housing 22 is mounted for linear motion in the shell 3, as by sliding in cooperating tracks, and a return spring 23 is connected between the shell 3 and the gripper to release the gripper from the plunger 6 when pressure is removed from the trigger. When the user pulls the trigger, lever 16 rotates about mount 17, and movement of the link 18 in turn rotates the gripper 20. When rotated, the gripper engages the bottom of the plunger, and the housing then moves forward to advance the plunger. In the preferred embodiment shown, the return spring 23 connected between the link 18 and the handle controls the rotation of the gripper and motion of the housing as is explained in the '705 patent. The return spring 23 causes the gripper to pivot downward immediately upon the user's releasing pressure on the trigger. The spring also pulls the housing rearward so that it will be in a position to engage the plunger again at a location whereby it can advance the plunger upon application of pressure to the trigger.

An important feature of the above construction is that the plunger is immediately disengaged from the advancing mechanism upon release of pressure on the trigger. This, in turn immediately releases the pressure in the cartridge that is caused by the plunger. This contrasts with those structures that do not immediately release the plunger and, thus, often drip undesirably.

The shell 3 further supports a drag element 25 that engages the plunger to prevent excessive rearward movement of the plunger when pressure on the trigger is released. This element may be a disc that fits in a groove in the shell 13 and has a central hole for allowing frictional passage of the plunger.

The trigger further includes a pressure relief spring 27 that prevents application of excessive pressure to the dispenser mechanisms.

Figure 4:
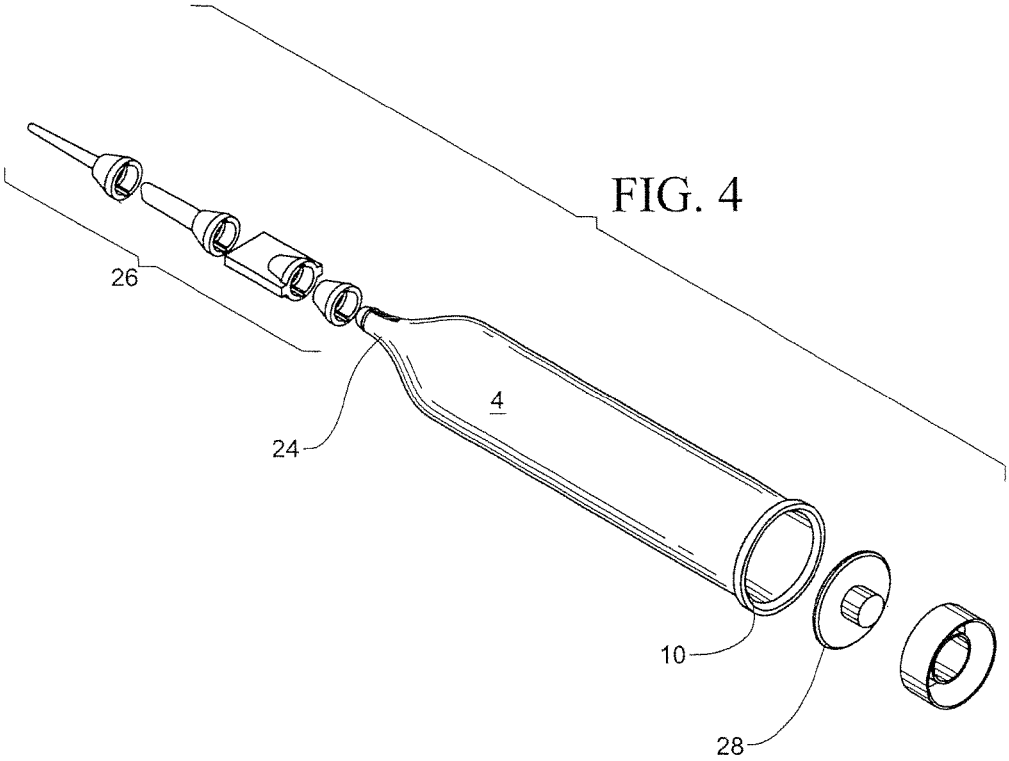
FIG. 4 is an exploded view of the cartridge of the glue gun of FIG. 1.

FIG. 4 illustrates the preferred construction of the cartridge 4. The cartridge is generally tubular for receiving the fluid material. An outlet 24 is located at a dispensing end of the cartridge and is configured to receive a selected dispensing tip 26, which may take any of several forms as illustrated depending on the particular project. For example, the tips may be broad to lay down a ribbon of material or may be cylindrical of various diameters. As noted, the tip may be oriented by rotating the cartridge.

Preferably, the cartridge is that described in published PCT application WO 2004/017205, which includes a valve 28 disposed in the front of the cartridge. This valve efficiently controls the discharge of the adhesive, and an important feature of the invention is the combination of the valve 28 and the feed mechanism. When pressure on the trigger is removed, the gripping mechanism immediately releases the plunger, which releases the pressure on the adhesive in the cartridge. The valve 28 is designed to close quickly in response to the reduced pressure and also has been found to operate as a diaphragm that draws material into the cartridge when pressure is released and the valve recovers is original configuration. The rapid release of pressure allows the drawback to take place and greatly reduces dripping.

Figure 3A:
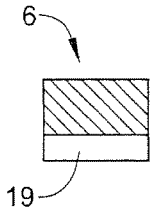
FIGS. 3*a* and 3*b* are alternate cross sections taken along line 3*a*-3*a* of FIG. 3.
Figure 3B:
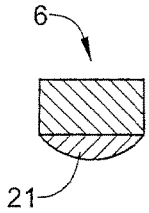

The plunger is preferably configured with a lower surface that cooperates with the gripper mechanism to provide fine control of the plunger. In one embodiment, the lower surface of the plunger is provided with teeth 19 (see FIG. 3*a*) that are engaged by the upper edge of the gripper when it pivots upward. The pitch of these teeth may be very small to provide accurate control. For example, a pitch of about 0.030 inch has been found useful. In another embodiment, the lower surface of the plunger is provided with a continuous layer 21 (see FIG. 3*b*) of urethane or a hard, rubber-like compound or other material that provides a good grip to the gripper, much as a glue stick, but that recovers its original shape and can be used repeatedly. The use of a continuous layer provides a micro-fine advancement of the plunger and is particularly useful when the desired pitch of the teeth is too small for practical manufacture.

Figure 5:
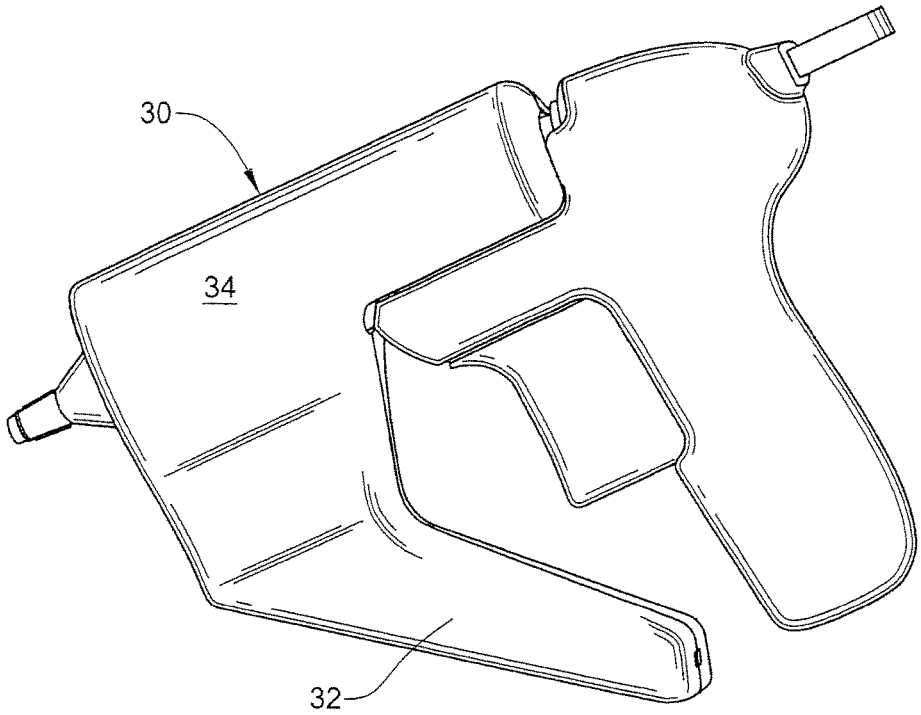
FIG. 5 is a perspective of the glue gun of FIG. 1 in a heater stand in accordance with the invention.

FIG. 5 illustrates another feature of the invention. A heater stand 30 is provided to receive the cartridge and to heat the adhesive in the cartridge. The stand includes a base part 32, which is designed to rest on a horizontal surface. An upper part 34 includes a cylindrical part for engaging the cartridge. Thus, the forward portion of the upper part 34 receives the forwardly extending part of the cartridge and engages the forward edge of the trigger portion of the handle, while the rear portion of the upper part extends rearward to cover the rear part of the cartridge.

Figure 6B:
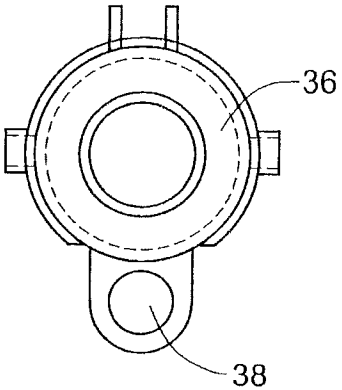
FIG. 6*b* is a front view of the heater element of FIG. 6*a*.
Figure 6A:
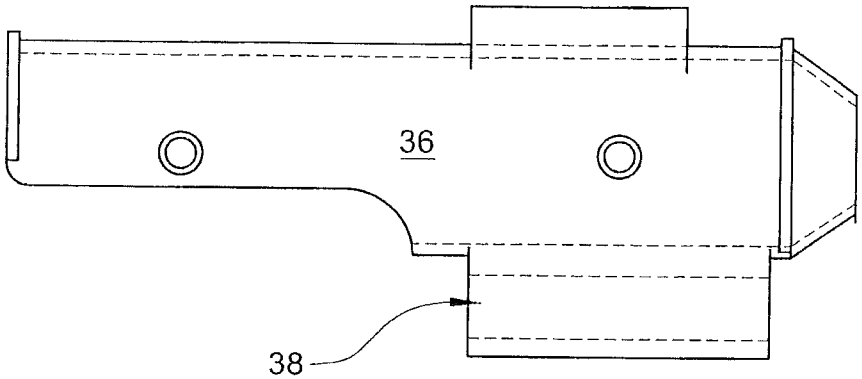
FIG. 6*a* is a side view of a heater element used in the heater stand of FIG. 5.

FIG. 6*a* is a side view of a heater casing 36 that is received in the heater stand shown in FIG. 5. The heater casing 36 is shaped to receive the cartridge and to also receive a heater element (not shown) in cavity 38. FIG. 6*b* is a rear view of the heater casing.

The heater is useful for those situations where the fluid material is to be kept warm during periods of non-use. The fluid materials in the cartridge may be of the type that become liquid or semi-liquid only when heated, and the heater stand may be used when such materials are used. The cartridge may be heated initially in the heater stand, but it is preferably heated in a separate heater where, for example, a plurality of cartridges may be heated initially. The heated stand, thus, preferably maintains the temperature of the fluid materials when the rate of usage is low enough that they might cool.

It will be appreciated that a unique dispenser has been disclosed. Modifications will be apparent to those of skill in the art.

We claim:

1. A dispenser for fluid materials comprising:

a handle portion for removably receiving a cartridge containing said fluid materials, said handle comprising an annular slot configured to receive a flange on one end of said cartridge and support said cartridge in an orientation extending forwardly of said handle portion such that said cartridge can be rotated about a longitudinal axis of said cartridge, said annular slot being open at its top and unobstructed whereby said flange of said cartridge can be inserted into said slot without displacement of any structure, a plunger mounted for linear motion along said longitudinal axis of said cartridge, a trigger portion extending forward of said annular slot and carrying a trigger positioned to be engaged by a user at a location forward of said annular slot, and a trigger mechanism for advancing said plunger into said cartridge from said one end to expel said fluid materials, said trigger mechanism comprising said trigger positioned to be engaged and actuated by a user's finger and a gripper mechanism connected to said trigger to engage said plunger in response to application of force to said trigger by said user, wherein said gripper mechanism engages said plunger upon application of pressure to said trigger and disengages completely from said plunger to allow said plunger to move away from said cartridge upon release of pressure from said trigger, and further comprising a drag element consisting of a flexible disc received in an annular groove in said handle portion and slidingly engaging said plunger in a friction fit to prevent excessive movement of said plunger away from said cartridge upon release of pressure from said trigger.

2. A dispenser according to claim 1 wherein said plunger comprises a surface having a plurality of teeth spaced in the direction of said longitudinal axis to be engaged by said gripper when pressure is applied to said trigger.

3. A dispenser according to claim 1 wherein said plunger comprises a substantially continuous resilient surface to be engaged by said gripper when pressure is applied to said trigger.

4. A dispenser according to claim 1 wherein said annular slot has an angular extent of about 180 degrees.

5. A dispenser according to claim 1 wherein said trigger mechanism further comprises a pressure relief element.

6. A dispenser according to claim 5 wherein said pressure relief element comprises a spring.

7. A dispenser according to claim 1 wherein said trigger mechanism comprises a return spring attached between said gripper and a shell.

8. A dispenser according to claim 1 in further combination with said cartridge.

9. A dispenser according to claim 1 in further combination with a heater stand for heating said cartridge when attached to said handle.

* * * * *